US011421496B1

(12) United States Patent
Nguyen et al.

(10) Patent No.: US 11,421,496 B1
(45) Date of Patent: Aug. 23, 2022

(54) MILL TO WHIPSTOCK CONNECTION SYSTEM

(71) Applicant: Baker Hughes Oilfield Operations LLC, Houston, TX (US)

(72) Inventors: Tuan Nguyen, Pearland, TX (US); Philip M. Gregurek, Pearland, TX (US); Kevin Edgar Harrington, Milano, TX (US); Gregory Hern, Porter, TX (US); Christopher Michalec, Richmond, TX (US); Gaute Grindhaug, Hafrsfjord (NO); Morten Eidem, Trondheim (NO)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/829,090

(22) Filed: Mar. 25, 2020

(51) Int. Cl.
*E21B 29/06* (2006.01)

(52) U.S. Cl.
CPC ..... *E21B 29/06* (2013.01)

(58) Field of Classification Search
CPC ..... E21B 29/06
See application file for complete search history.

(56) References Cited

U.S. PATENT DOCUMENTS 3,115,933 A 12/1963 Haeber
3,223,164 A 12/1965 Otteman
5,109,924 A 5/1992 Juergens et al.
5,431,220 A * 7/1995 Lennon ..... E21B 7/061 166/117.6
5,474,126 A 12/1995 Lynde et al.
5,592,991 A 1/1997 Lembcke et al.
5,709,265 A 1/1998 Haugen et al.
5,718,291 A 2/1998 Lorgen et al.
5,803,176 A 9/1998 Blizzard, Jr. et al.
5,878,818 A 3/1999 Hebert et al.
6,032,740 A * 3/2000 Schnitker ..... E21B 29/06 166/117.5
6,464,002 B1 * 10/2002 Hart ..... E21B 7/061 166/117.6

(Continued)

FOREIGN PATENT DOCUMENTS

EP 0916014 A1 5/1999
WO 02097234 A1 12/2002

(Continued)

OTHER PUBLICATIONS

"Timken introduces two high performance alloy steel grades" Offshore Magazine, Offshore Staff, Nov. 11, 2013 (pp. 1-5).

(Continued)

*Primary Examiner* — Taras P Bemko
(74) *Attorney, Agent, or Firm* — Cantor Colburn LLP

(57) ABSTRACT

A window cutting system includes a whipstock connector including an inner surface having at least one projection. A window mill is connected to the whipstock connector. The window mill includes a body having a connector member, a tip portion, a recess formed on an outer surface of the body, an axial passage extending from the connector member toward the tip portion and a radial passage extending outwardly from the axial passage. A pin is arranged in the radial passage and selectively extending into the recess.

31 Claims, 18 Drawing Sheets

(56) References Cited

U.S. PATENT DOCUMENTS

| | | | | |
|---|---|---|---|---|
| 6,550,540 | B2 | 4/2003 | Trent | |
| 6,695,056 | B2 | 2/2004 | Haugen et al. | |
| 7,878,253 | B2 | 2/2011 | Stowe et al. | |
| 8,327,944 | B2 | 12/2012 | King et al. | |
| 8,453,729 | B2 | 6/2013 | Harris et al. | |
| 8,469,096 | B2 | 6/2013 | McGarian | |
| 8,967,279 | B2 | 3/2015 | Hered et al. | |
| 9,267,355 | B2 | 2/2016 | Lumbye | |
| 10,227,823 | B2 | 3/2019 | Hern et al. | |
| 10,563,471 | B2 | 2/2020 | Georgsen et al. | |
| 10,724,319 | B2 | 7/2020 | Hulsewe | |
| 2002/0170713 | A1* | 11/2002 | Haugen | E21B 17/07 166/298 |
| 2004/0007390 | A1 | 1/2004 | Zupanick | |
| 2004/0238171 | A1 | 12/2004 | McGarian et al. | |
| 2005/0039905 | A1 | 2/2005 | Hart et al. | |
| 2007/0044954 | A1 | 3/2007 | Dewey | |
| 2009/0266544 | A1 | 10/2009 | Redlinger et al. | |
| 2010/0224372 | A1 | 9/2010 | Stowe et al. | |
| 2010/0270031 | A1 | 10/2010 | Patel | |
| 2010/0307736 | A1 | 12/2010 | Hearn et al. | |
| 2010/0319997 | A1 | 12/2010 | King et al. | |
| 2012/0255785 | A1* | 10/2012 | Gregurek | E21B 7/061 175/57 |
| 2012/0261193 | A1 | 10/2012 | Swadi et al. | |
| 2013/0020084 | A1 | 1/2013 | Goodson | |
| 2013/0199791 | A1 | 8/2013 | Hill, Jr. et al. | |
| 2013/0269928 | A1 | 10/2013 | Zhou | |
| 2013/0341048 | A1 | 12/2013 | Delgado et al. | |
| 2014/0020904 | A1 | 1/2014 | Hill, Jr. et al. | |
| 2015/0152703 | A1 | 6/2015 | Haun | |
| 2016/0238055 | A1 | 8/2016 | Donovan | |
| 2016/0348456 | A1* | 12/2016 | LaPlante | E21B 29/06 |
| 2017/0306711 | A1 | 10/2017 | Hern et al. | |
| 2017/0328177 | A1 | 11/2017 | Sheehan et al. | |
| 2018/0209232 | A1 | 7/2018 | Hulsewe | |
| 2018/0209233 | A1* | 7/2018 | Hulsewe | E21B 29/06 |
| 2018/0320480 | A1* | 11/2018 | Jelly | E21B 34/063 |
| 2018/0334872 | A1 | 11/2018 | Vuyk | |
| 2019/0003264 | A1 | 1/2019 | Swadi et al. | |
| 2019/0106940 | A1 | 4/2019 | Korf et al. | |
| 2019/0120005 | A1 | 4/2019 | Hulsewe | |
| 2020/0011134 | A1* | 1/2020 | Nevlud | E21B 7/061 |

FOREIGN PATENT DOCUMENTS

| | | | |
|---|---|---|---|
| WO | 2006070204 | A2 | 7/2006 |
| WO | 2016209686 | A1 | 12/2016 |

OTHER PUBLICATIONS

C95400 Product Spec Sheet; Concast Metal Products, Jul. 27, 2010 (pp. 1-2).

C95510 Product Spec Sheet; Concast Metal Products, Dec. 22, 2010 (pp. 1-2).

Notification of Transmittal of the International Search Report and the Written Opinion of the International Searching Authority, or the Declaration; PCT/US2017/066117; dated Mar. 29, 2018; 13 pages.

Notification of Transmittal of the International Search Report and the Written Opinion of the International Searching Authority, or the Declaration; PCT/US2017/066119; dated Mar. 29, 2018; 10 pages.

International Search Report and Written Opinion for International Application No. PCT/US2021/023602; International Filing Date Mar. 23, 2021; Report dated Jul. 1, 2021 (pp. 1-7).

International Search Report and Written Opinion for International Application No. PCT/US2021/023603; International Filing Date Mar. 23, 2021; Report dated Jul. 1, 2021 (pp. 1-7).

International Search Report and Written Opinion for International Application No. PCT/US2021/023604; International Filing Date Mar. 23, 2021; Report dated Jul. 1, 2021 (pp. 1-9).

International Search Report and Written Opinion for International Application No. PCT/US2021/023605; International Filing Date Mar. 23, 2021; Report dated Jul. 1, 2021 (pp. 1-8).

International Search Report and Written Opinion for International Application No. PCT/US2021/023606; International Filing Date Mar. 23, 2021; Report dated Jul. 1, 2021 (pp. 1-7).

International Search Report and Written Opinion for International Application No. PCT/US2021/023609; International Filing Date Mar. 23, 2021; Report dated Jul. 5, 2021 (pp. 1-10).

* cited by examiner

MILL TO WHIPSTOCK CONNECTION SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, the window mill/whipstock is made up on a rig floor. The window mill includes a threaded hole and the whipstock includes a lug hole. Typically, the whipstock is mounted in a rotary table and the window mill is brought into position such that the threaded hole and lug hole are aligned. A shear bolt is passed through the lug hole and connected with the window mill. Aligning the openings and connecting the shear bolt at the rig floor can be a difficult and time consuming process. Given the need to increase efficiency at the rig floor, the art would be open to new systems for joining a window mill to a whipstock.

SUMMARY

Disclosed is a window cutting system including a whipstock connector including an inner surface having at least one projection. A window mill is connected to the whipstock connector. The window mill includes a body having a connector member, a tip portion, a recess formed on an outer surface of the body, an axial passage extending from the connector member toward the tip portion and a radial passage extending outwardly from the axial passage. A pin is arranged in the radial passage and selectively extending into the recess.

Also disclosed is a method of detaching a window mill from a whipstock connector including adjusting a fluid force applied to the window mill, and shifting a pin extending between the window mill and the whipstock connector.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
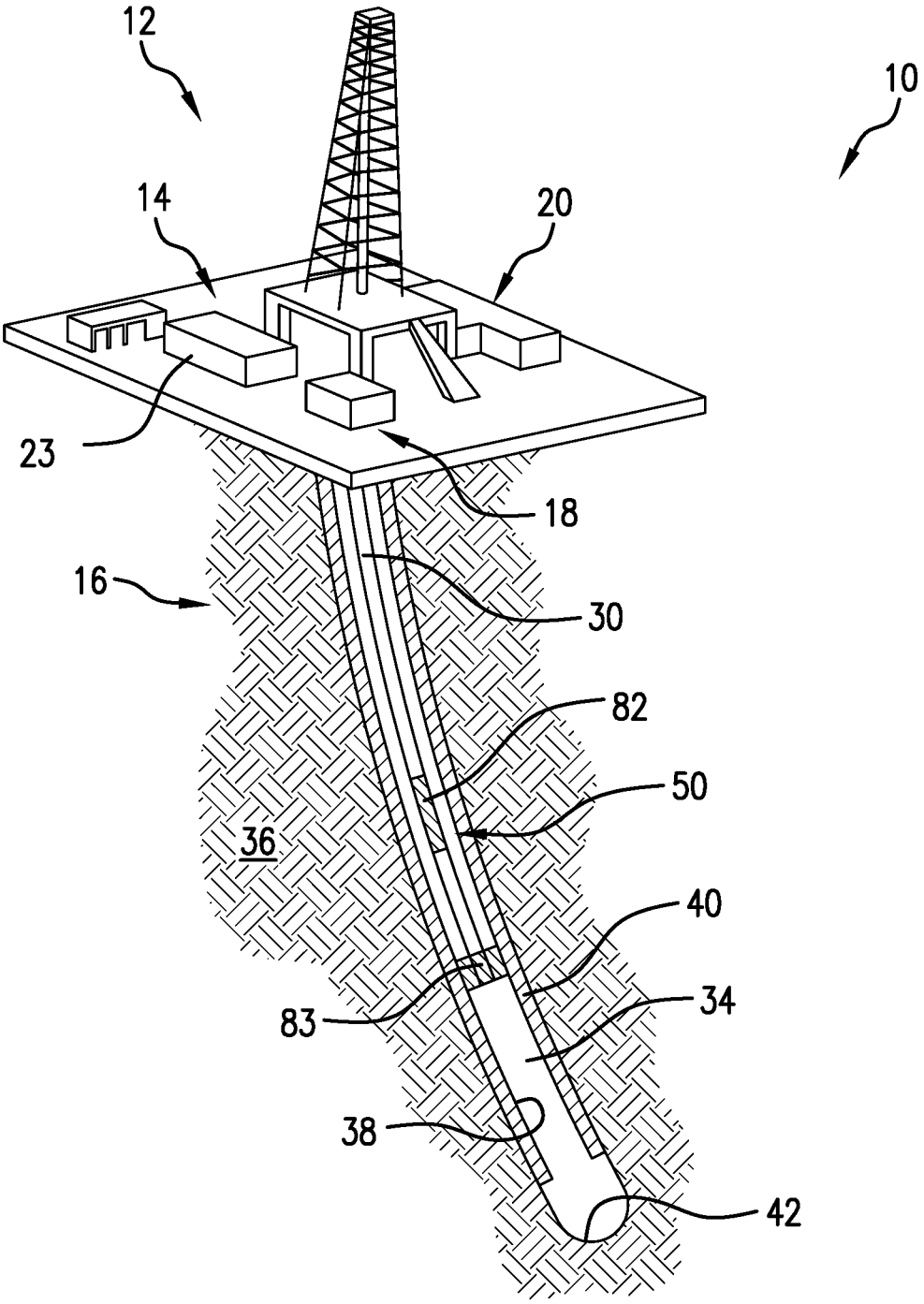
FIG. 1 depicts a resources exploration and recovery system including a window mill to whipstock connection system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
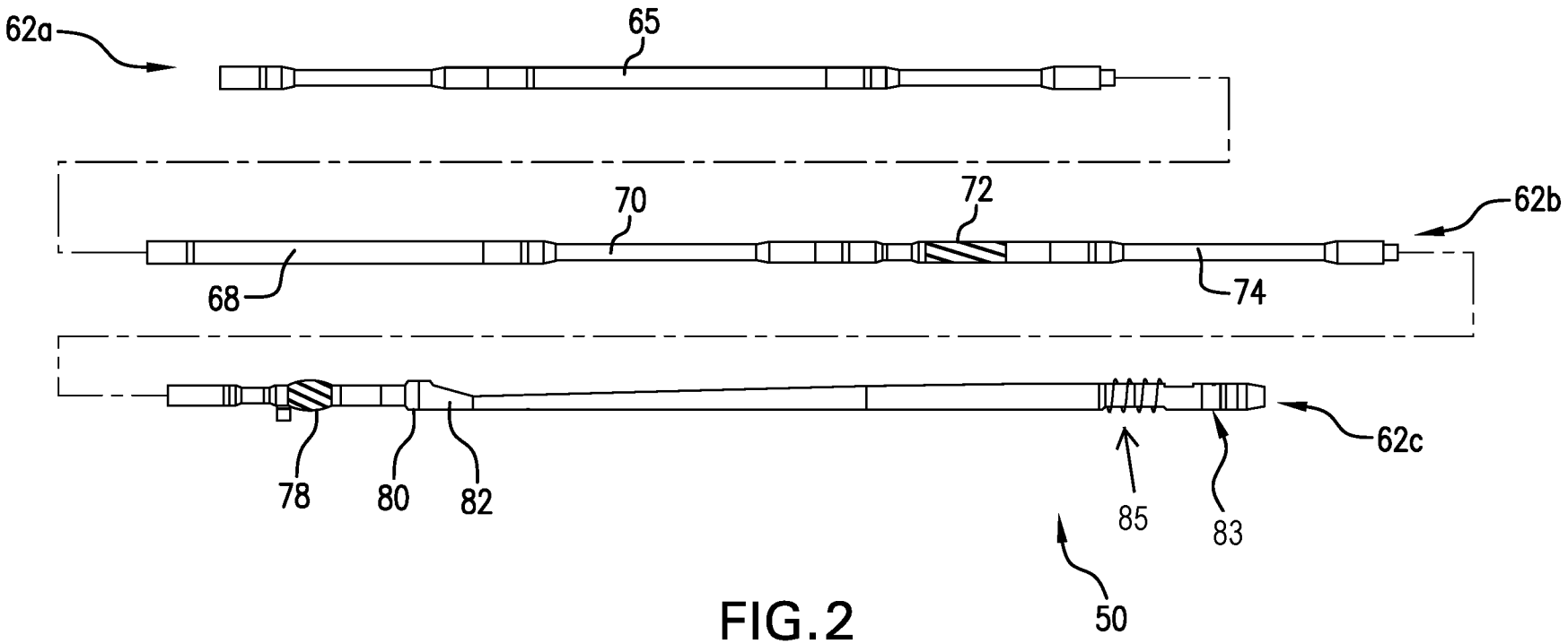
FIG. 2 depicts a window cutting system including a window mill and whipstock connector, in accordance with an exemplary embodiment.
Figure 3:
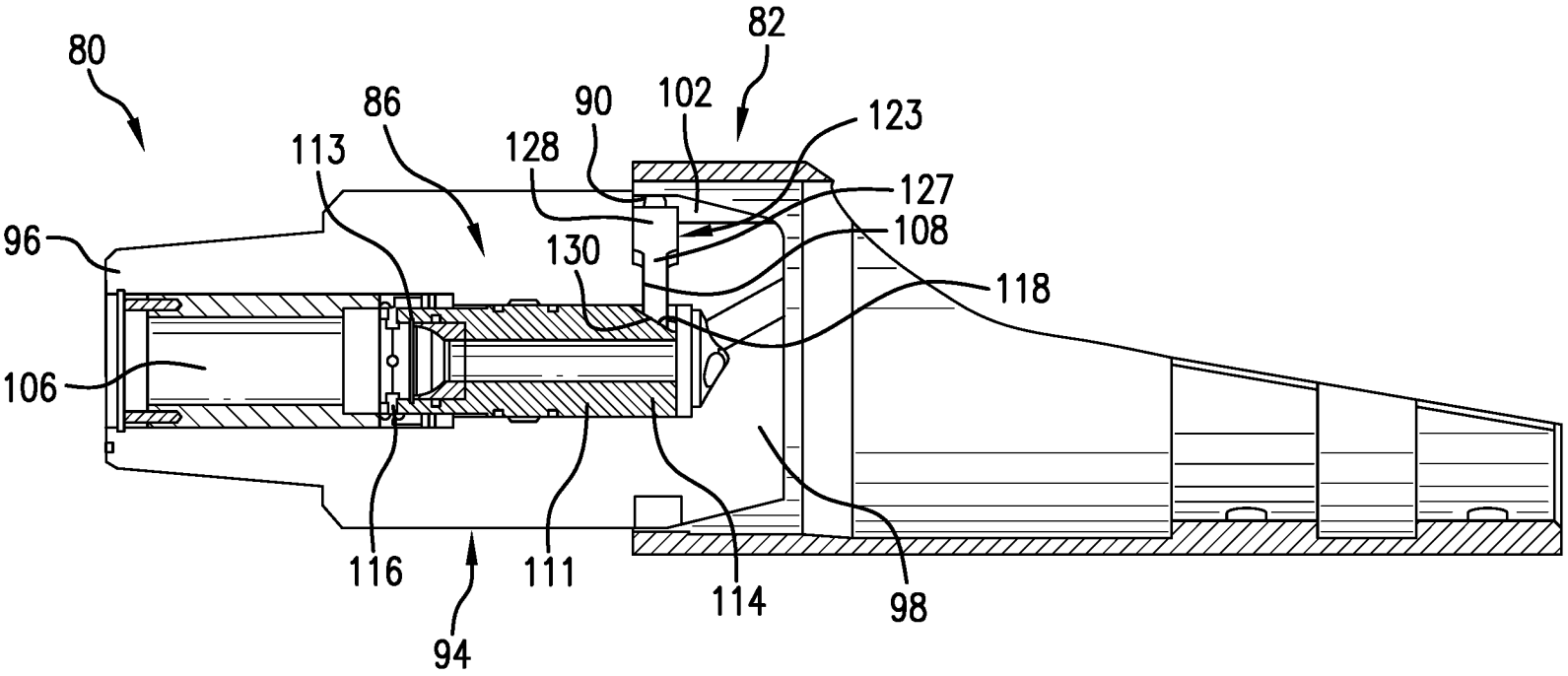
FIG. 3 depicts a glass view of the window mill joined to the whipstock connector through the connection system, in accordance with an exemplary aspect.
Figure 4:
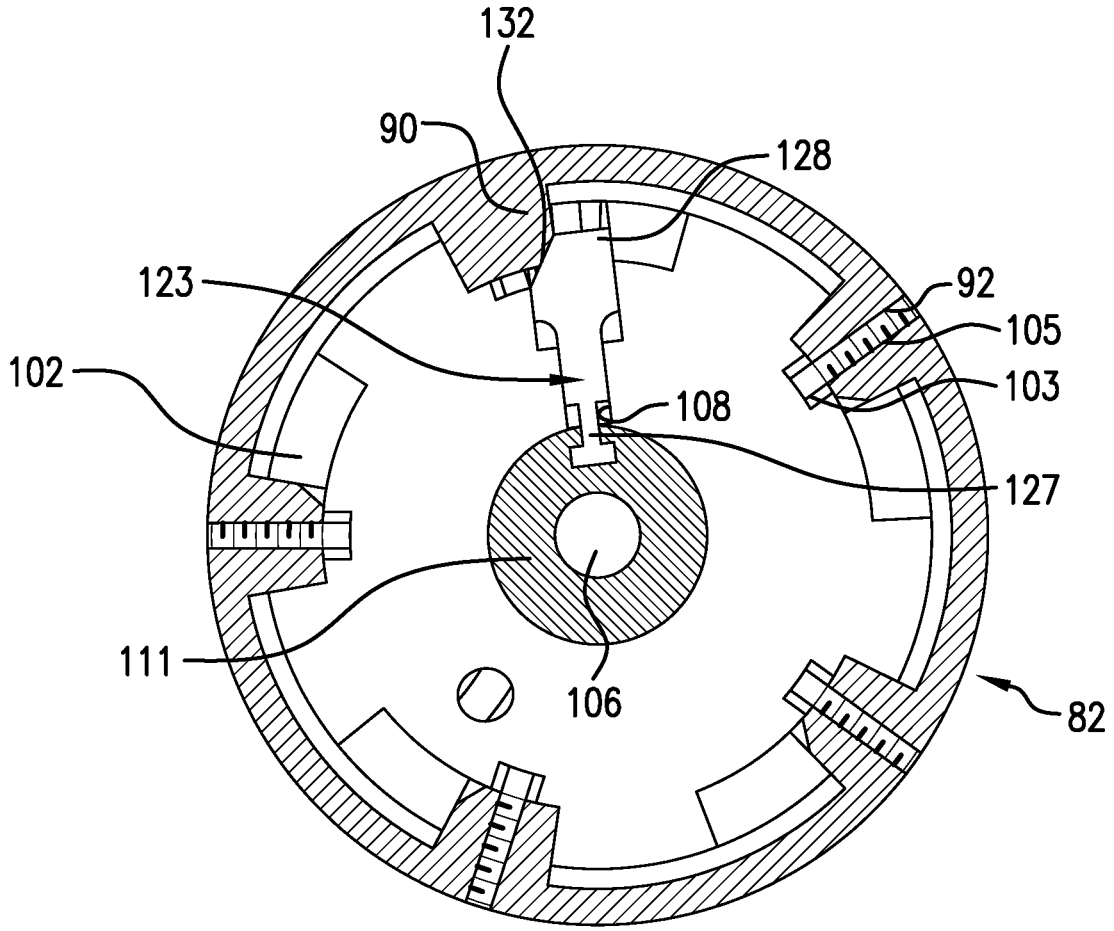
FIG. 4 depicts an axial end view of the connection system joining the window mill to the whipstock connector, in accordance with an exemplary aspect.
Figure 5:
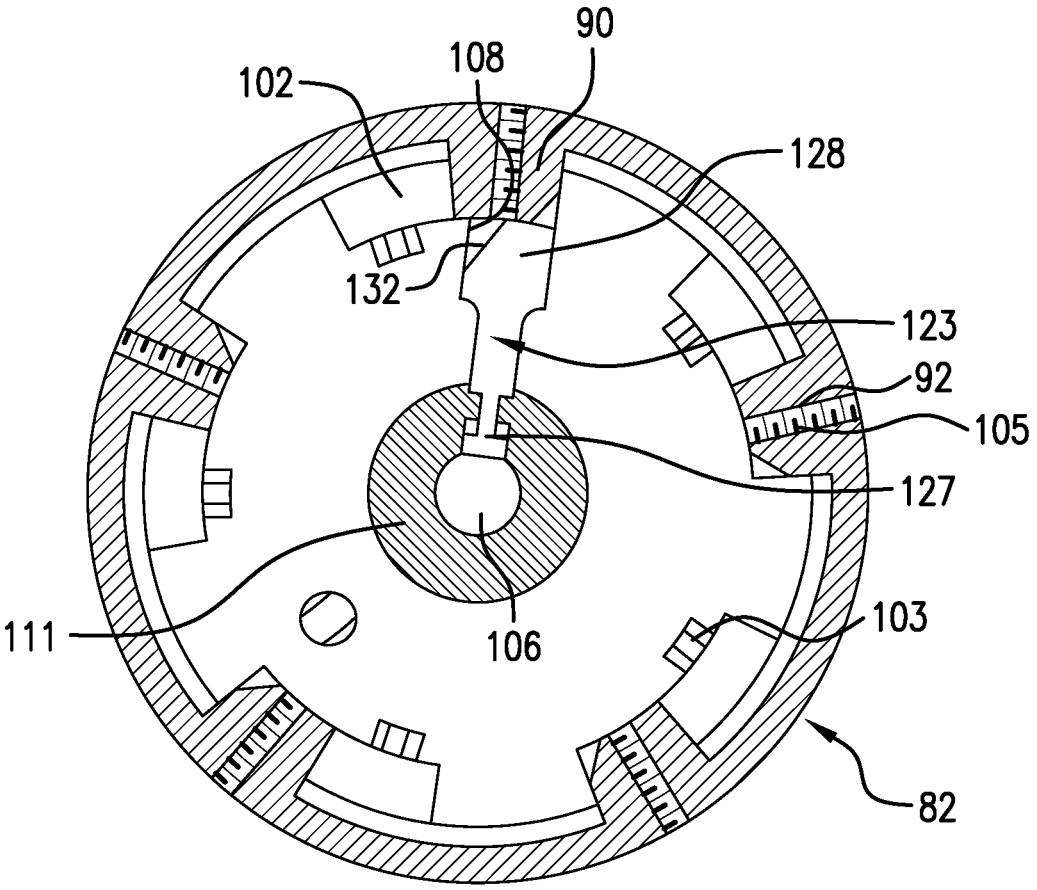
FIG. 5 is an axial end view of the connection system of FIG. 4 depicting a release of the window mill, in accordance with an exemplary aspect.
Figure 6:
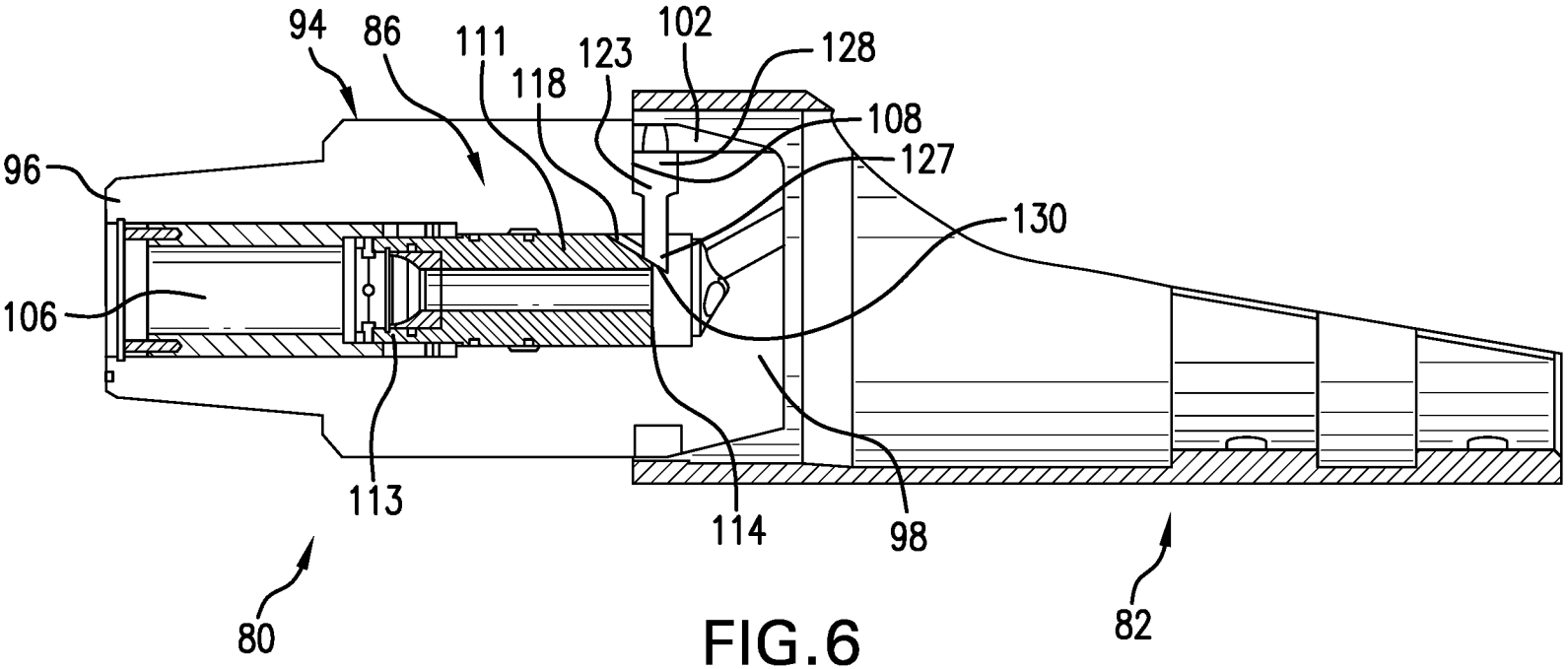
FIG. 6 depicts the window mill of FIG. 3 being released from the whipstock connector, in accordance with an exemplary aspect.

In accordance with an exemplary aspect, a window cutting system 50 is connected to tubular string 30 as is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems that monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, and an anchor 83. Third segment 62*c* may also support a brush or scraper 85 arranged adjacent to anchor 83.

Referring to FIGS. 3-6, window mill 80 is secured to whipstock connector 82 through a connection system 86 as will be detailed herein. In an embodiment, whipstock connector 82 includes a plurality of projections or lugs, one of which is indicated at 90 in FIGS. 4 and 5, that extend into and lock to window mill 80. A threaded opening 92 extends through each of the plurality of projections 90. Window mill 80 includes a body 94 having a connector member 96 and a tip portion 98. Connector member 96 acts as an interface with lower watermelon mill 78, and a tip portion 98. A plurality of blades (not shown) extend along body 94 and support a number of cutters (also not shown).

In an embodiment, body 94 includes a plurality of recesses or lug pockets, one of which is indicated at 102, that may take the form of a J-slot which is designed to receive a corresponding one of projections 90. Each recess 102 may include a passage 103. With this arrangement, a frangible fastener 105 may pass from whipstock connector 82 into passage 103. Frangible fastener 105 may be threaded into threaded opening 92 and selectively, releasably, retains window mill 80 to whipstock connector 82. Body 94 also includes an axial passage 106 and a plurality of radial passages, one of which is indicated at 108. Axial passage 106 extends from connector member 96 towards tip portion 98. Radial passages 108 extend from axial passage 106 radially outwardly through body 94.

In accordance with an exemplary embodiment, a piston 111 is disposed in axial passage 106. Piston 111 includes first end portion 113 and a second end portion 114. First end portion 113 is secured in axial passage 106 through a frangible element 116. In an embodiment, frangible element 116 is designed to fail when exposed to a selected shear force. Second end portion 114 includes an angled surface portion 118 that registers with radial passage 108. A pin, one of which is shown at 123, is arranged in each of the radial passages 108. Other pins 123 are not shown for the sake of drawing clarity. Pin 123 includes a first end 127 and a second end 128. First end 127 includes a first angled surface 130 that compliments angled surface portion 118 on piston 111 and second end 128 includes a second angled surface 132. At this point, it should be understood that a frangible member (not shown) may be arranged radially inwardly of first end 127 to prevent undesirable radial inward movement of pin 123.

In operation, window mill 80 is joined to whipstock connector 82 to form third segment 62*c*. Third segment 62*c* may be positioned in wellbore 34 and held in place by a rotary table (not shown). Second segment 62*b* may be joined to third segment 62*c*. The rotary table may then be released, third segment 62*c* and second segment 62*b* lowered into wellbore 34. The rotary table may then be closed on second segment 62*b* and the process continues to form tubular string 30.

Window cutting system 50 is deployed to a selected depth in wellbore 34 and anchor 83 may be set. During run in, fluid pressure may be passed into axial passage 106. The fluid may originate at first system 12. The fluid act on piston 111 such that angled surface portion 118 acts on first angled surface 130 causing pin 123 to project radially outwardly into recesses 102. When it is desired to disconnect window mill 80, fluid flow is terminated. In the absence of flow, pin 123 may be urged radially inwardly.

In an embodiment, once the flow is halted, window mill 80 is rotated in a selected direction causing projections 90 to move through a first portion of recesses 102 and engage second end 128 of pin 123. Projections 90 urge pin radially inwardly such that second angled surface 132 imparts an axially upwardly directed force on piston 111. Once the axially upwardly directed force reaches a selected level, frangible element 116 will fail allowing piston 111 to move axially upwardly and pin 123 to move radially inwardly. At this point, window mill 80 may be rotated and lifted allowing projections 90 to pass through recesses 102 thereby releasing window mill 80 from whipstock connector 82. At this point, a window milling operation may commence.

When window cutting system 50 is deployed, minimal torque capability is needed between mill 80 and connector 82. High torque capability is only needed when orienting the face of the whipstock, rotating the assembly through a deviation or tight spot in the casing, or rotating a scraper or brush 85 to clean the casing. When high torque is needed fluid can be pumped through piston 111 causing pin 123 move radially outward and reduce the rotational force being applied to frangible fasteners 105. Once the high torque capability is no longer needed the pumps can be turned off and deployment operations can continue to locate the window cutting system at the proper depth. Once whipstock is oriented anchor 83 may be set. Once anchor 83 is set window mill may be rotated to break frangible fasteners 105 allowing projections 90 to pass through recesses 102 thereby releasing window mill 80 from whipstock connector 82. At this point, a window milling operation may commence.

Figure 7:
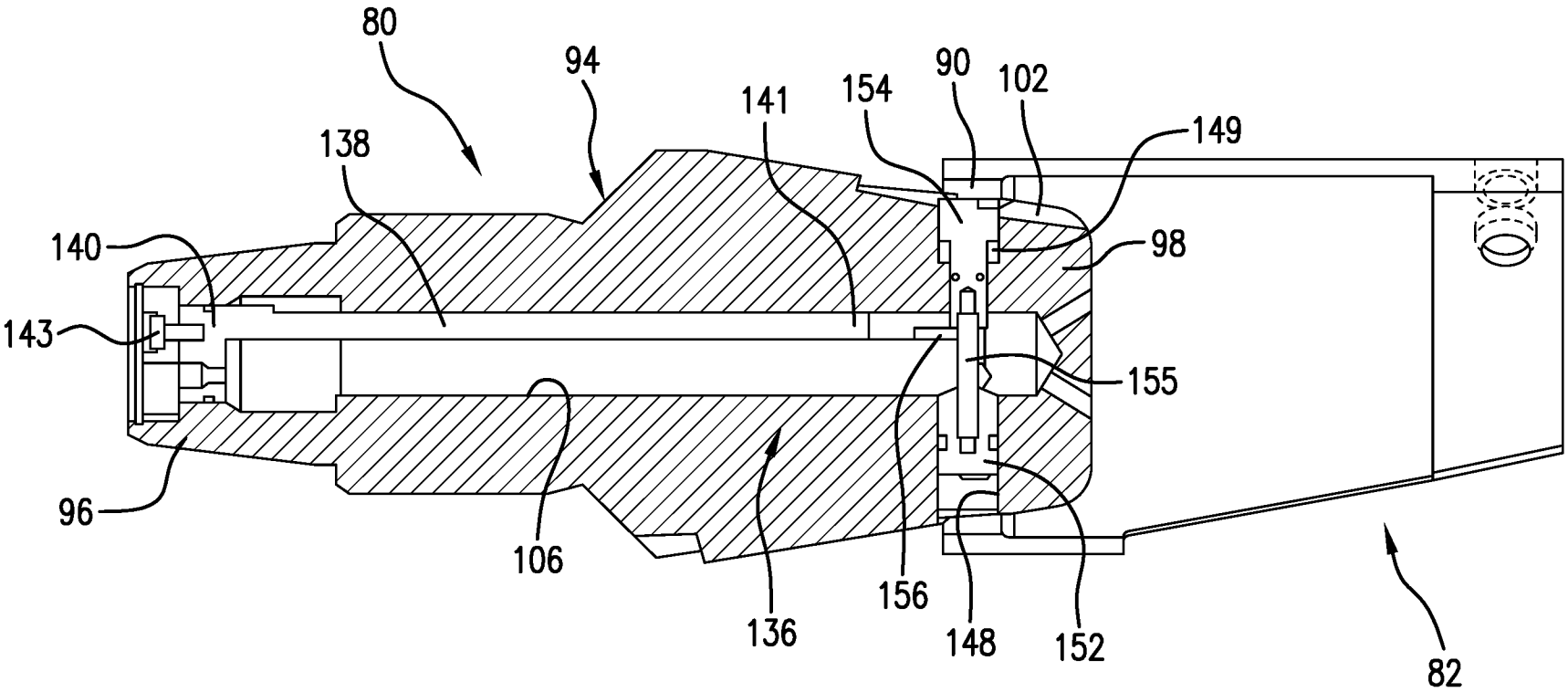
FIG. 7 depicts a glass view of the window mill joined to the whipstock connector through a connection system, in accordance with another exemplary aspect.
Figure 8:
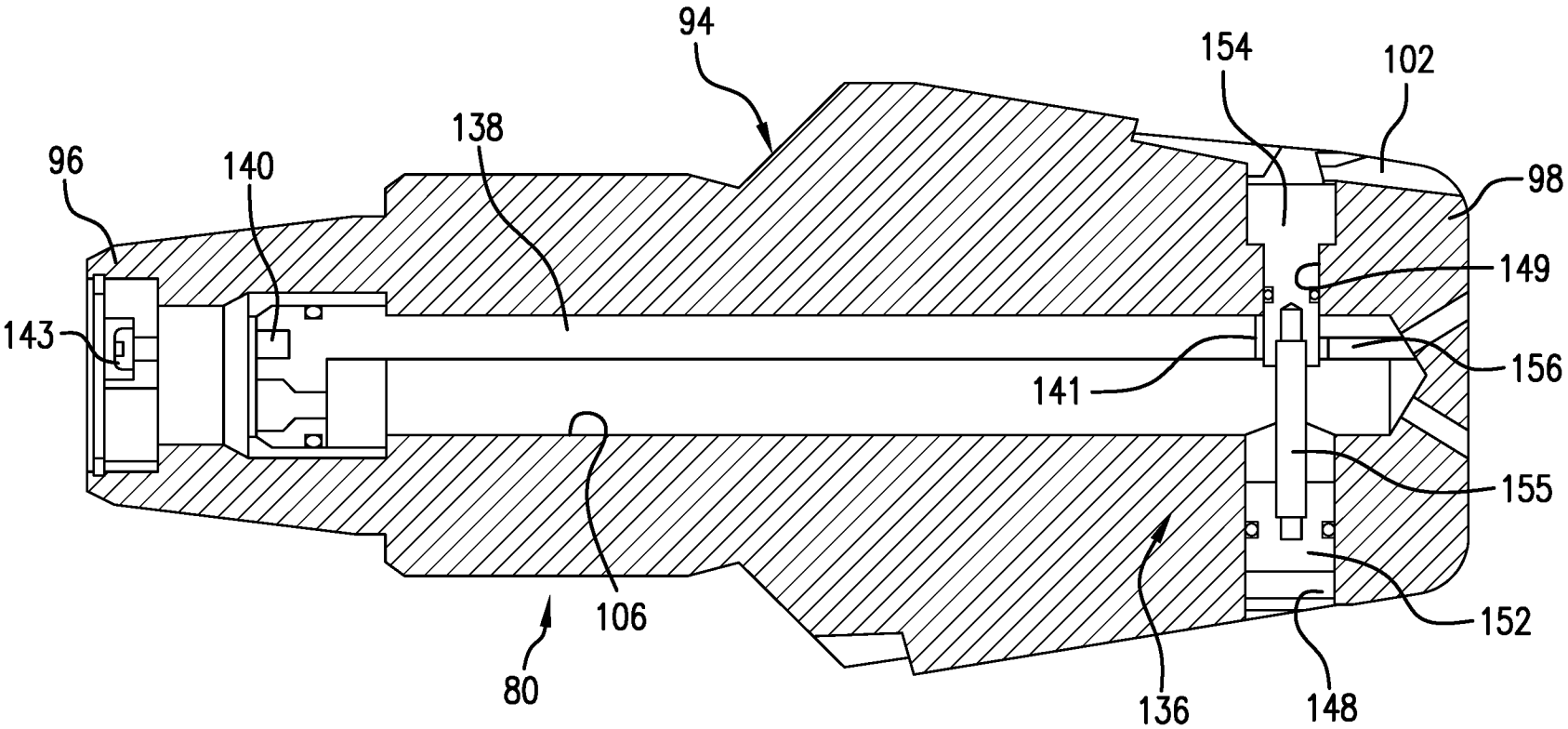
FIG. 8 depicts a glass view of the window mill of FIG. 7 being released from the whipstock connector, in accordance with an exemplary aspect.

Reference will now follow to FIGS. 7 and 8, wherein like reference numbers represent corresponding parts in the respective views, in describing a connection system 136 in accordance with another exemplary aspect. In the embodiment shown, window mill 80 includes a piston 138 arranged in axial passage 106. Piston 138 includes a first end portion 140 and a second end portion 141. First end portion 140 is secured to body 94 in axial passage 106 through a frangible element 143. Frangible element 143 may take the form of a frangible stud (not separately labeled) that is designed to fail when exposed to a selected tensile force. Window mill 80 includes a first radial passage 148 and a second radial passage 149. First and second radial passages 148 and 149 extend from axial passage 106 radially outwardly through body 94.

In an embodiment, a first pin 152 may be arranged in first radial passage 148 and a second pin 154 may be arranged in second radial passage 149. Each pin 152, 154 may include seals (not separately labeled) that engage with first and second radial passages 148 and 149 respectively. First pin 152 may be joined to second pin 154 through a linking member 155. First pin 152 may project radially outwardly into recesses 102 while second pin 154 may be reside wholly within second radial passage 149. A travel limiter 156 is arranged between first pin 152 and second pin 154. Travel limiter 156 may abut second end portion 141 of piston 138.

In a manner similar to that discussed above, window mill 80 is joined to whipstock connector 82 to form third segment 62*c*. Third segment 62*c* may be positioned in wellbore 34 and held in place by a rotary table (not shown). Second segment 62*b* may be joined to third segment 62*c*. The rotary table may then be released, third segment 62*c* and second segment 62*b* lowered into wellbore 34. The rotary table may then be closed on second segment 62*b* and the process continues to form tubular string 30.

Window cutting system 50 is deployed to a selected depth in wellbore 34 and anchor 83 may be set. When it is desired to disconnect window mill 80, a fluid may be passed into axial passage 106. The fluid may originate at first system 12. The fluid act on piston 111. The pressure of the fluid increases such that the force on frangible connector 143 exceeds the selected tensile force. At this point, piston 138 may travel within axial passage 106 and act upon travel limiter 156. Travel limiter 156 is moved axially downwardly allowing first pin 152 to move radially inwardly. Once first pin 152 moved inwardly, window mill 80 may be rotated and lifted allowing projections 90 to pass through recesses 102 thereby releasing whipstock 52. At this point, a window milling operation may commence.

Figure 9:
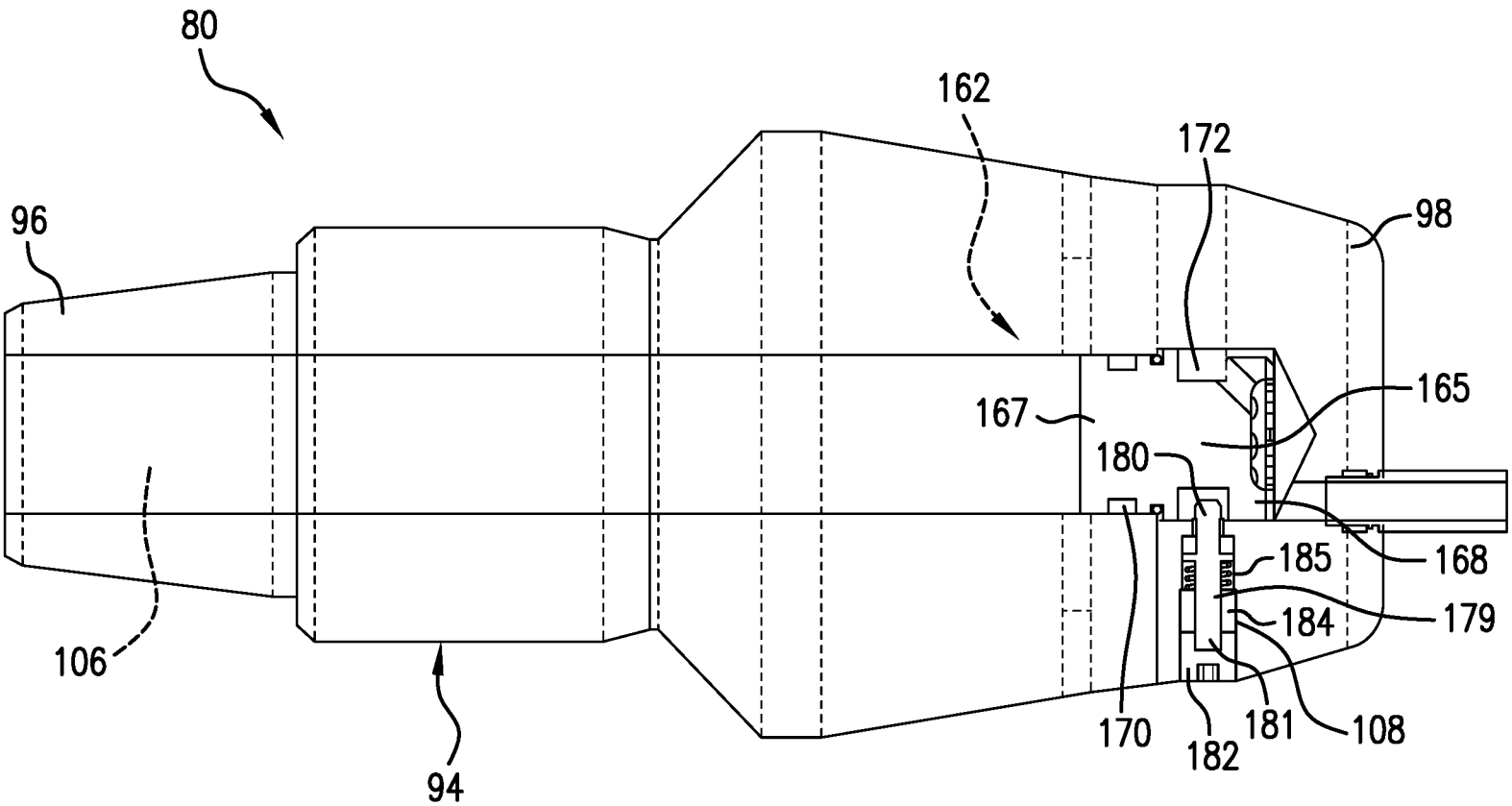
FIG. 9 depicts a glass view of the window mill including a connection system, in accordance with an exemplary aspect.
Figure 10:
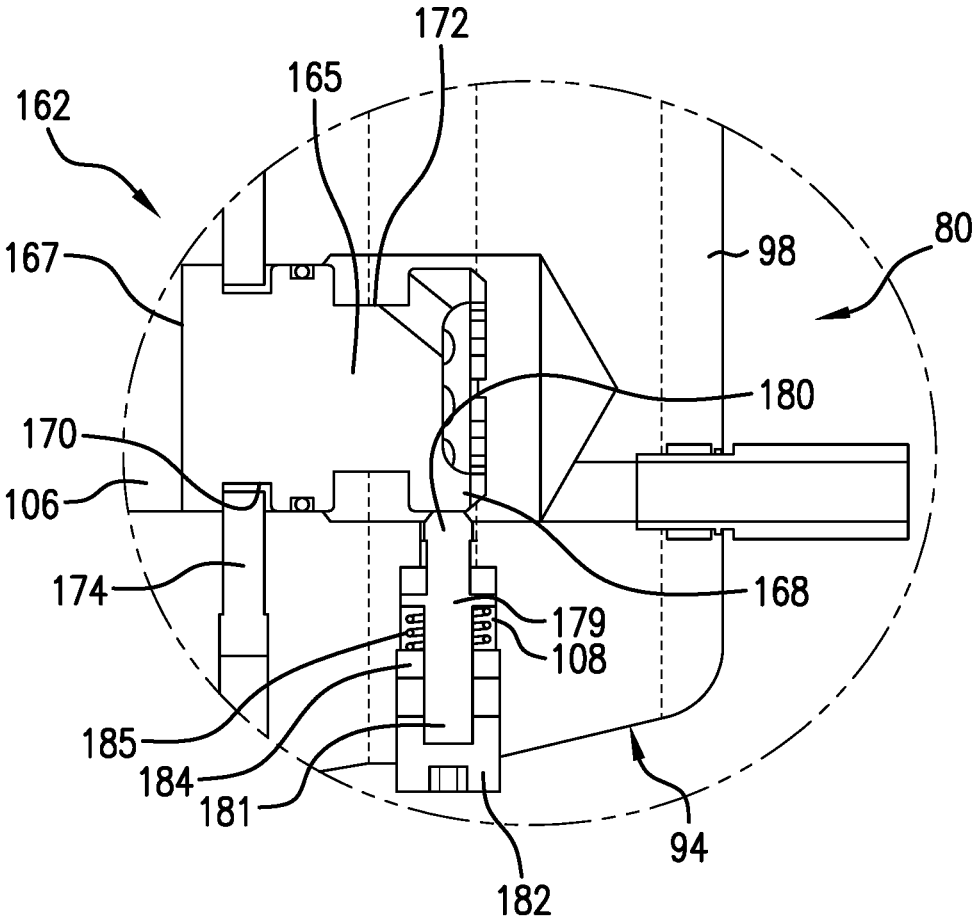
FIG. 10 is a detail view of the connection system of FIG. 9 prior to being released from the whipstock connector.

Reference will now follow to FIGS. 9-10, wherein like reference numbers represent corresponding parts in the respective views, in describing a connection system 162 in accordance with another aspect of an exemplary embodiment. In the embodiment shown, a piston 165 is disposed in axial passage 106. Piston 165 includes a first end portion 167 and a second end portion 168. A first annular recess 170 is arranged adjacent first end portion 167 and a second annular recess 172 is arranged adjacent second end portion 168. A plurality of frangible elements, one of which is indicated at 174 extend from body 94 into first annular recess 170 to affix piston 165 in axial passage 106. Frangible element 174 is designed to fail when exposed to a selected shear force.

In accordance with an exemplary aspect, a pin 179 is arranged in radial passage 108. Pin 179 includes a first end 180 and a second end 181. Second end 181 supports a poppet assembly 182 that selectively projects radially outwardly into recesses 102. A fixed element 184 is arranged in radial passage 108 at second end 181. A spring 185 is arranged about pin 179. Spring 185 is compressed between fixed member 184 and a flange element (not separately labeled) extending from pin 179.

Window cutting system 50 is deployed to a selected depth in wellbore 34 and anchor 83 may be set. When it is desired to disconnect window mill 80, a fluid may be passed into axial passage 106. The fluid may originate at first system 12. The fluid acts on piston 165. The pressure of the fluid is increased such that the force on frangible connector 174 exceeds the selected shear force. At this point, piston 165 may travel within axial passage 106. At this point, spring 185 biases pin 179 into second annular recess 172. Once first pin 179 moved inwardly, window mill 80 may be rotated and lifted allowing projections 90 to pass through recesses 102 thereby releasing whipstock 52. At this point, a window milling operation may commence.

Figure 11:
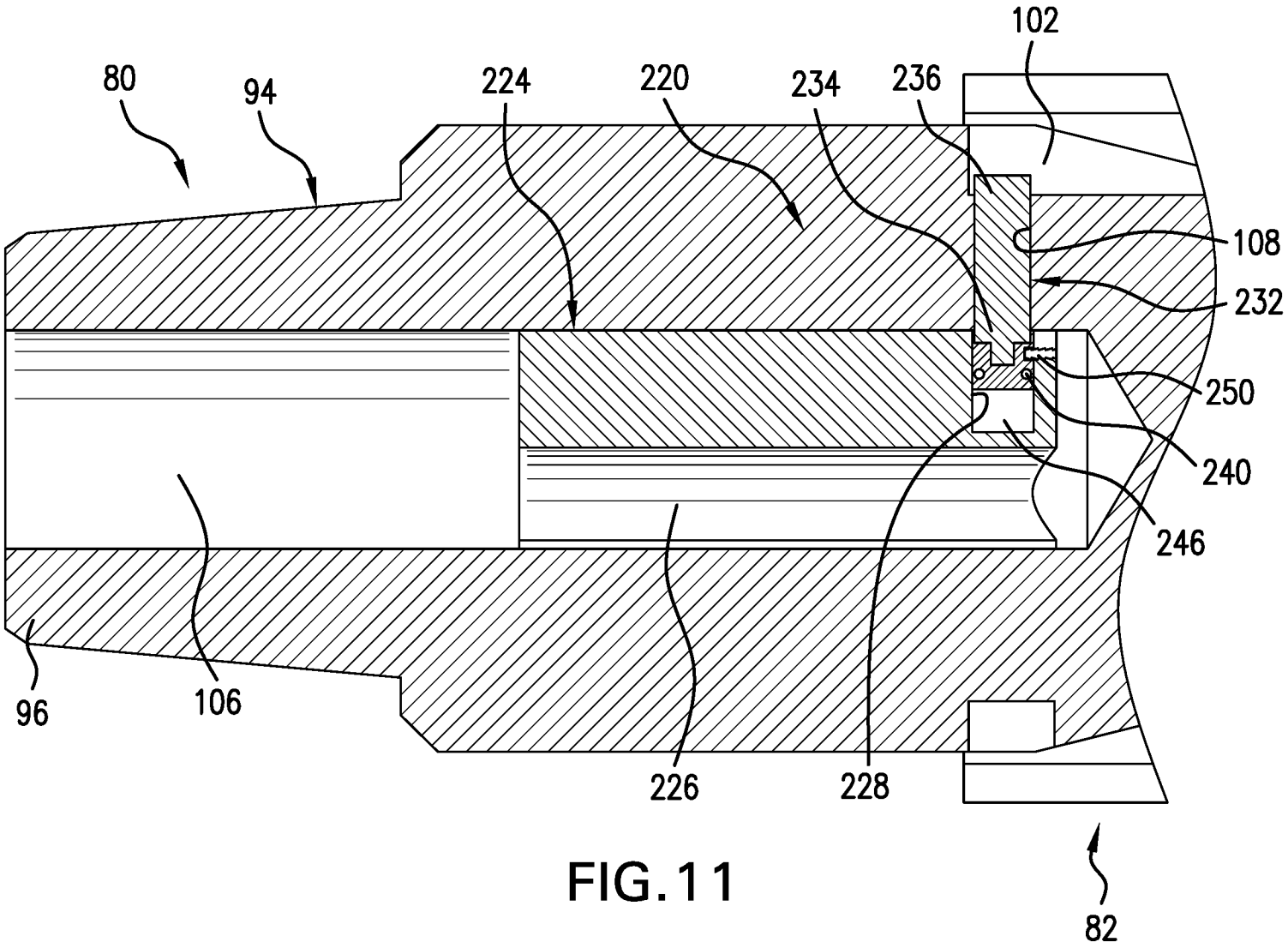
FIG. 11 depicts a glass view of the window mill joined to the whipstock connector through a connection system, in accordance with yet another exemplary aspect.
Figure 12:
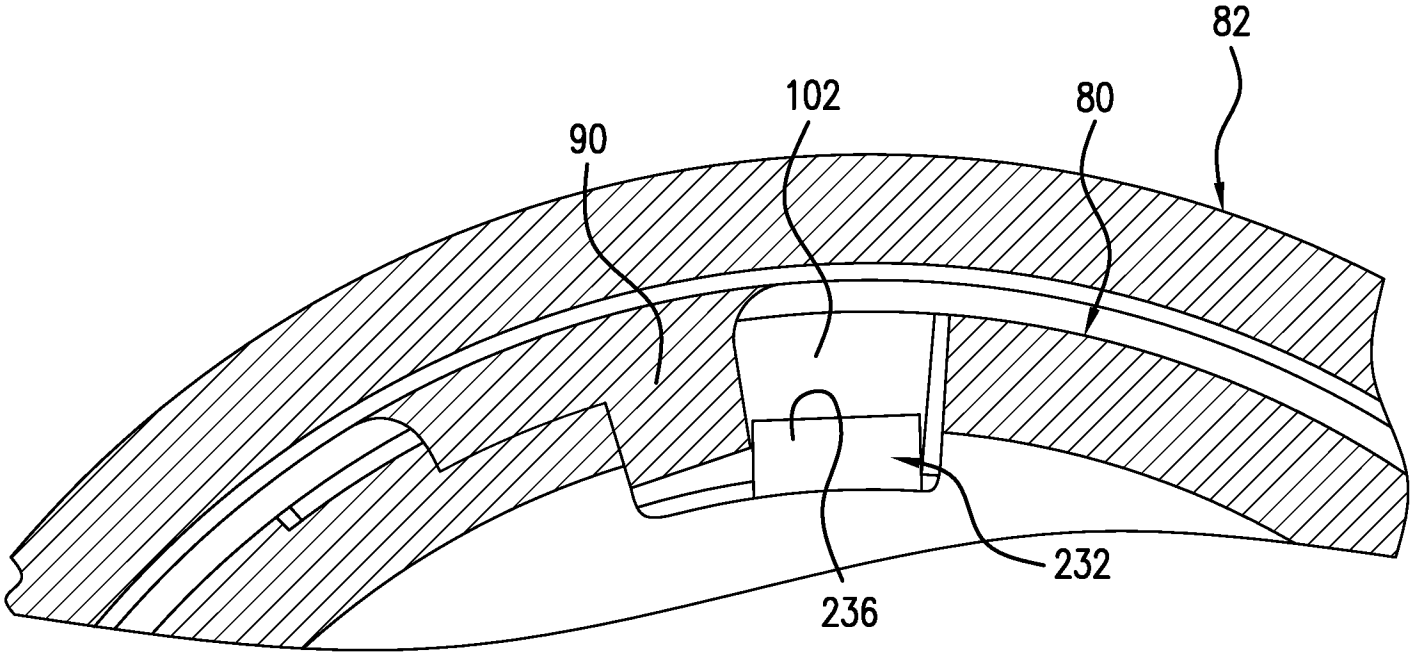
FIG. 12 depicts an axial end view of the connection system of FIG. 11 joining the window mill to the whipstock connector, in accordance with an exemplary aspect.
Figure 13:
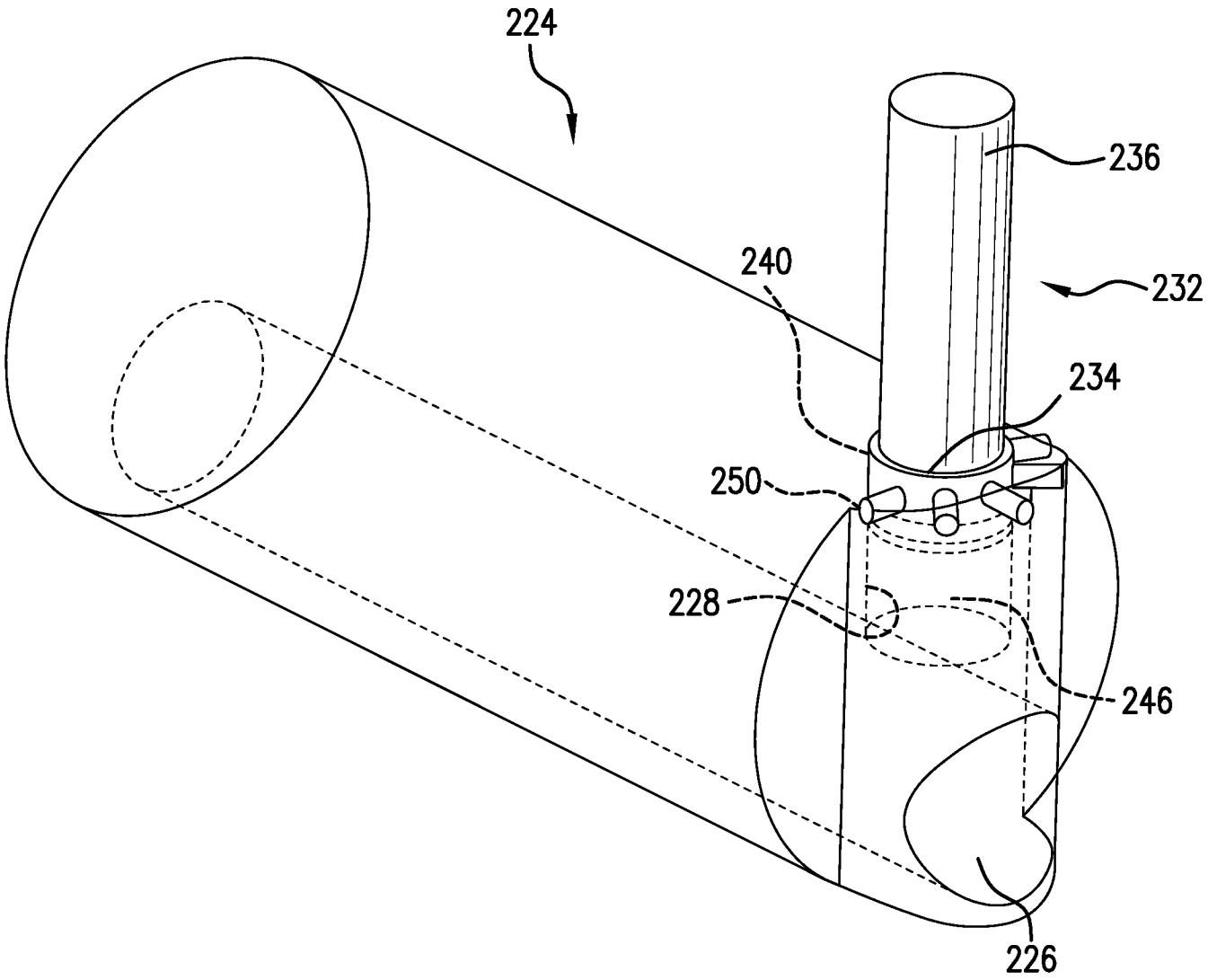
FIG. 13 depicts a glass view of a portion of the window mill of FIG. 11 illustrating a release pin, in accordance with an exemplary aspect.
Figure 15:
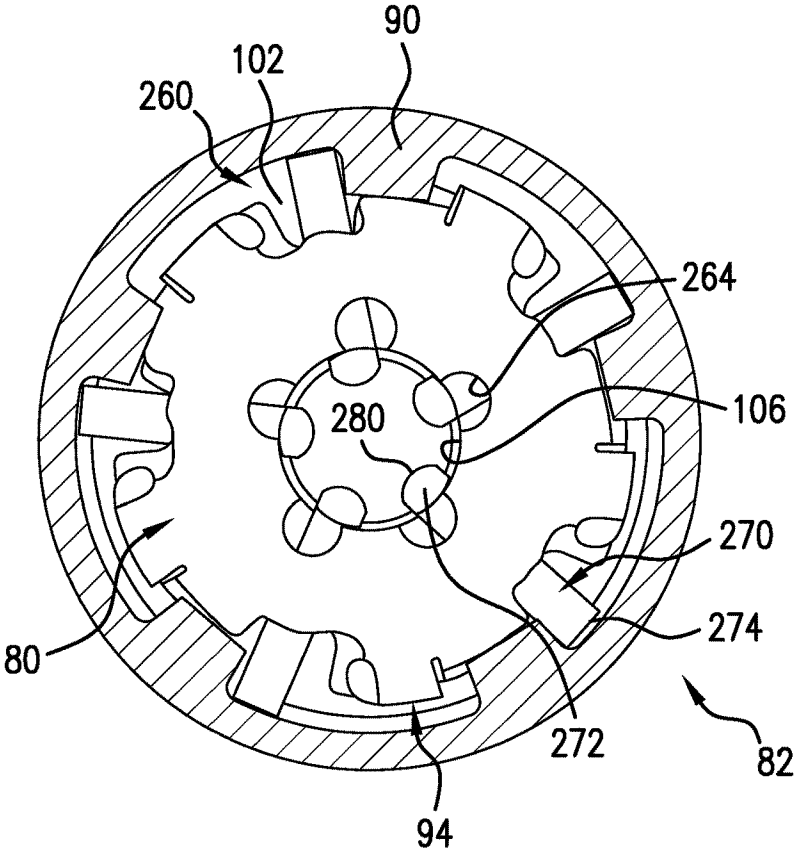
FIG. 15 depicts an axial end view of the connection system of FIG. 14 in a locked configuration, in accordance with still yet another exemplary aspect.

Reference will now follow to FIGS. 11-13, wherein like reference numbers represent corresponding parts in the respective views, in describing a connection system 220 in accordance with still yet another aspect of an exemplary embodiment. Connection system 220 includes an insert 224 that is arranged in axial passage 106. Insert 224 includes a central axial passage 226 that registers with axial passage 106 as well as one or more pin pockets 228 that extend radially outwardly and register with one or more of radial passages 108.

Figure 14:
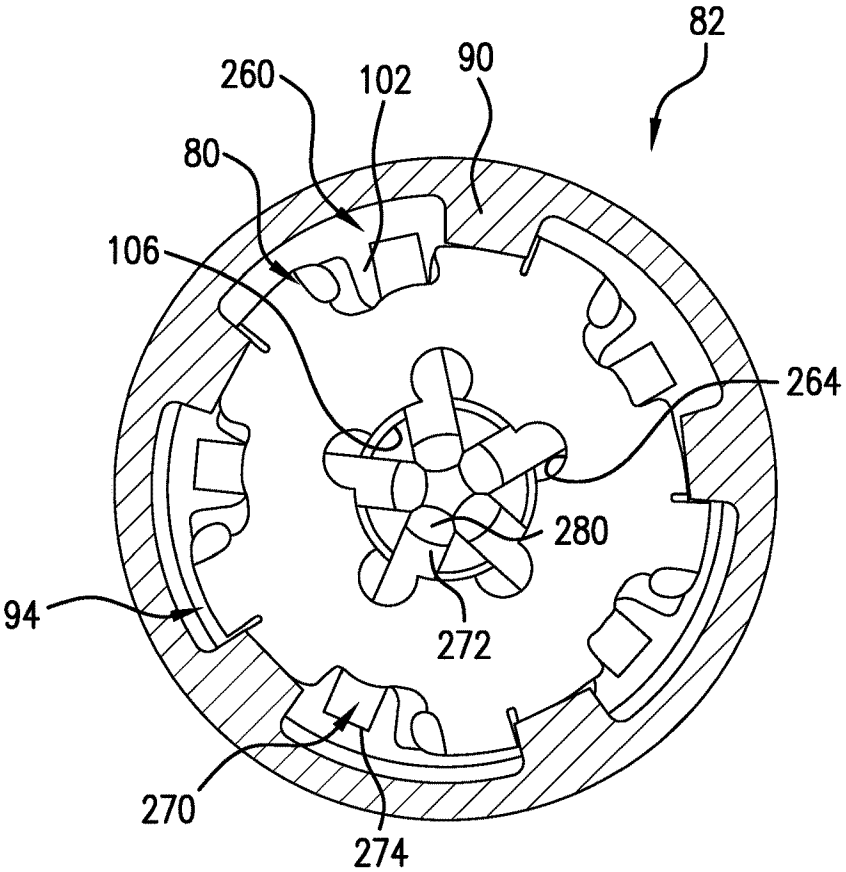
FIG. 14 depicts an axial end view of a connection system for joining the window mill to the whipstock connector shown in an unlocked configuration, in accordance with still yet another exemplary aspect.
Figure 17:
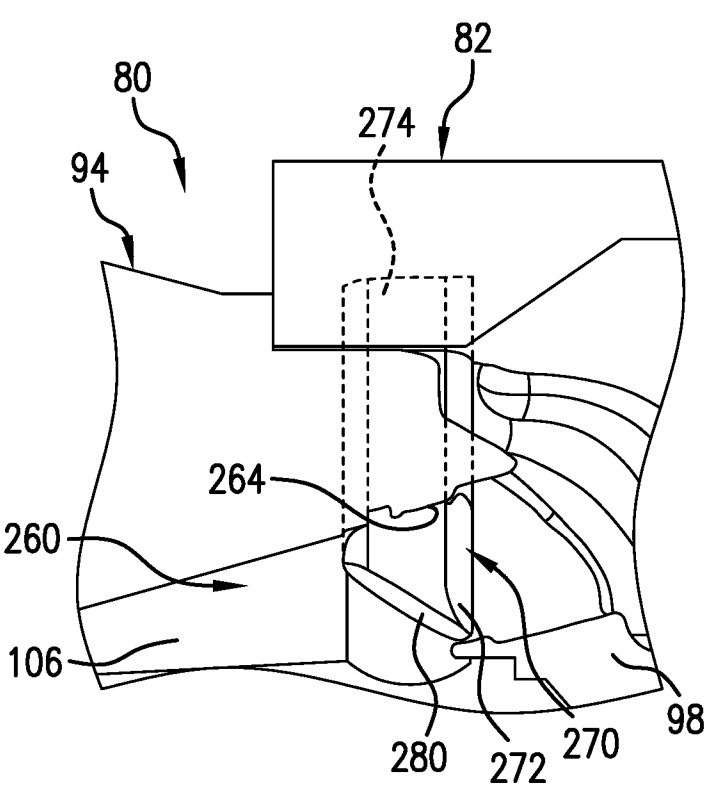
FIG. 17 depicts a cross-sectional side view of the connection system of FIG. 14 in the locked configuration.
Figure 16:
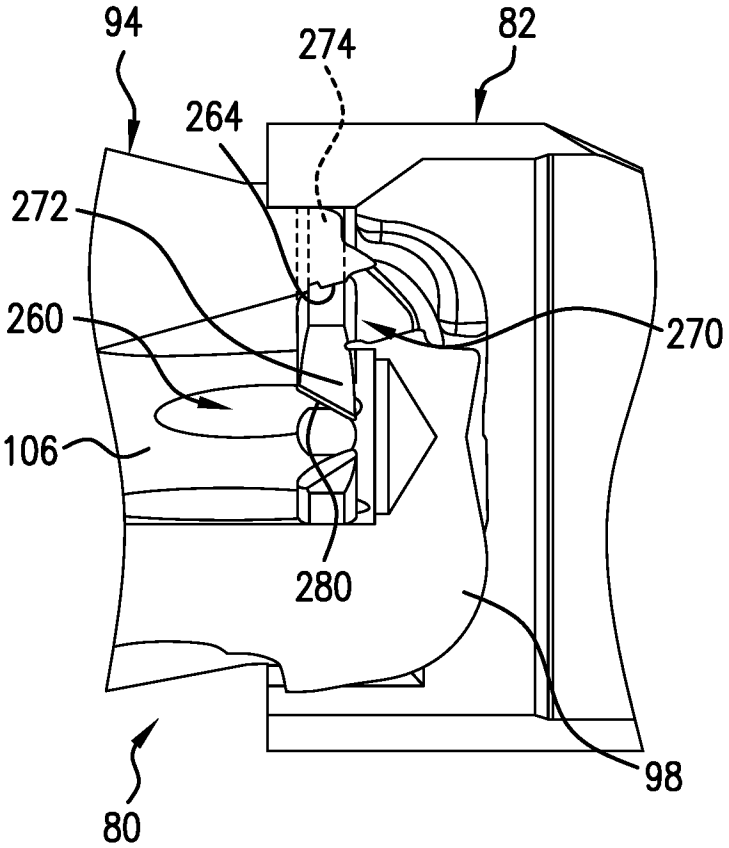
FIG. 16 depicts a cross-sectional side view of the connection system of FIG. 14 in the unlocked configuration.

A pin 232 is arranged in pin pocket 228. Pin 232 includes a first end 234 and a second end 236. First end 234 resides in pin pocket 228 while second end 236 selectively extends into recess 102. A seal 240 is arranged on first end 234. Seal 240 forms an atmospheric chamber 246 in pin pocket 228. A frangible link 250 may releasable lock seal 240 in pin pocket 228. At this point, it should be understood that the number of pin pockets and pins may vary. As shown in FIG. 14, pin pockets and pins may extend entirely annularly about insert 224.

In a manner also similar to that discussed above, window mill 80 may be joined to whipstock connector 82 by extending pin(s) 232 into recesses 102. Third segment 62*c* may be positioned in wellbore 34 and held in place by a rotary table (not shown). Second segment 62*b* may be joined to third segment 62*c*. The rotary table may then be released, third segment 62*c* and second segment 62*b* lowered into wellbore 34. The rotary table may then be closed on second segment 62*b* and the process continues to form tubular string 30.

Window cutting system 50 is deployed to a selected depth in wellbore 34 and anchor 83 may be set. When it is desired to disconnect window mill 80, a pressurized fluid may be passed into wellbore 34. The pressurized fluid acts on each pin 236 resulting in breaking frangible links 250 allowing movement of pin 236 into atmospheric chamber 246. At this point, window mill 80 may be rotated and lifted allowing projections 90 to pass from recesses 102 thereby releasing from whipstock connector 82. At this point, a window milling operation may commence.

Reference will now follow to FIGS. 14-17, wherein like reference numbers represent corresponding parts in the respective views, in describing a connection system 260 in accordance with still yet another aspect of an exemplary embodiment. In the embodiment shown, window mill 80 includes a plurality of radial passages, one of which is indicated at 264 that extend from axial passage 106 through body 94. Axial passages 264 may extend at a non-perpendicular angle relative to axial passage 106.

Connection system 260 includes a pin 270 arranged in one or more of radial passages 264. Pin 270 includes a first end 272 and a second end 274. First end 272 includes an angled surface 280 (FIG. 17) that is exposed to axial passage 106. In the unlocked configuration (FIGS. 14 and 16) angled surface 280 blocks flow from axial passage 106 through radial passages 264. With this arrangement, a fluid flow, even small amounts of low pressure fluid flow passing through axial passage 106 of window mill 80 may act upon each angled surface 280. The fluid forces each pin 270 from a first or unlocked configuration (FIGS. 14 and 16) to a second or locked configuration (FIGS. 15 and 17) thereby securing window mill 80 to whipstock connector 82. When it is desired to release from whipstock connector 82, fluid force pushing pin radially outwardly is stopped. Window mill 80 may then be rotated to push pins 270 radially inwardly and break any remaining frangible fasteners and/or frangible elements and disconnect from whipstock connector 82.

Figure 18:
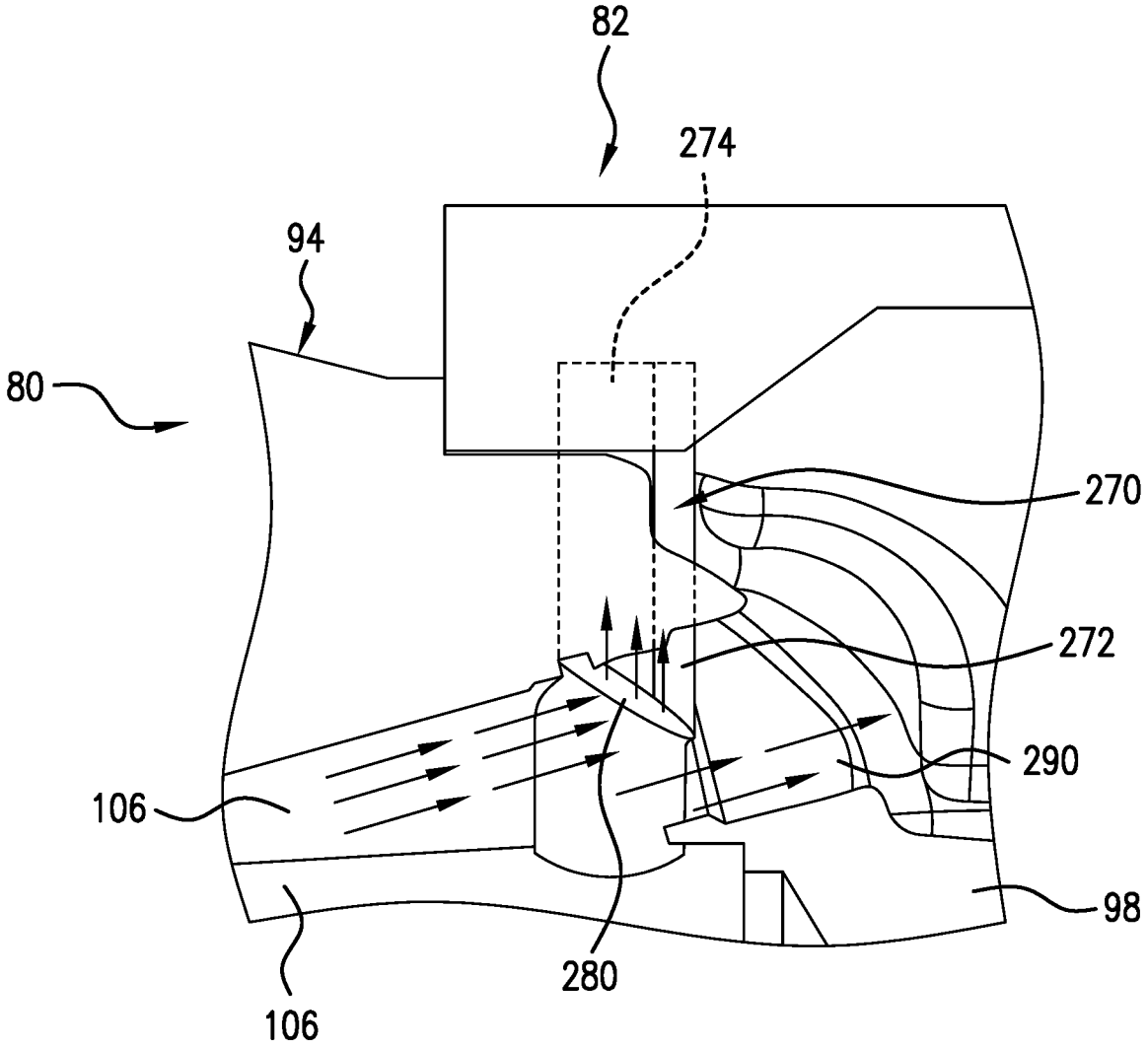
FIG. 18 depicts a partial cross-sectional view of a connection system illustrating fluid flow shifting release pins radially outwardly into the locked configuration.
Figure 19:
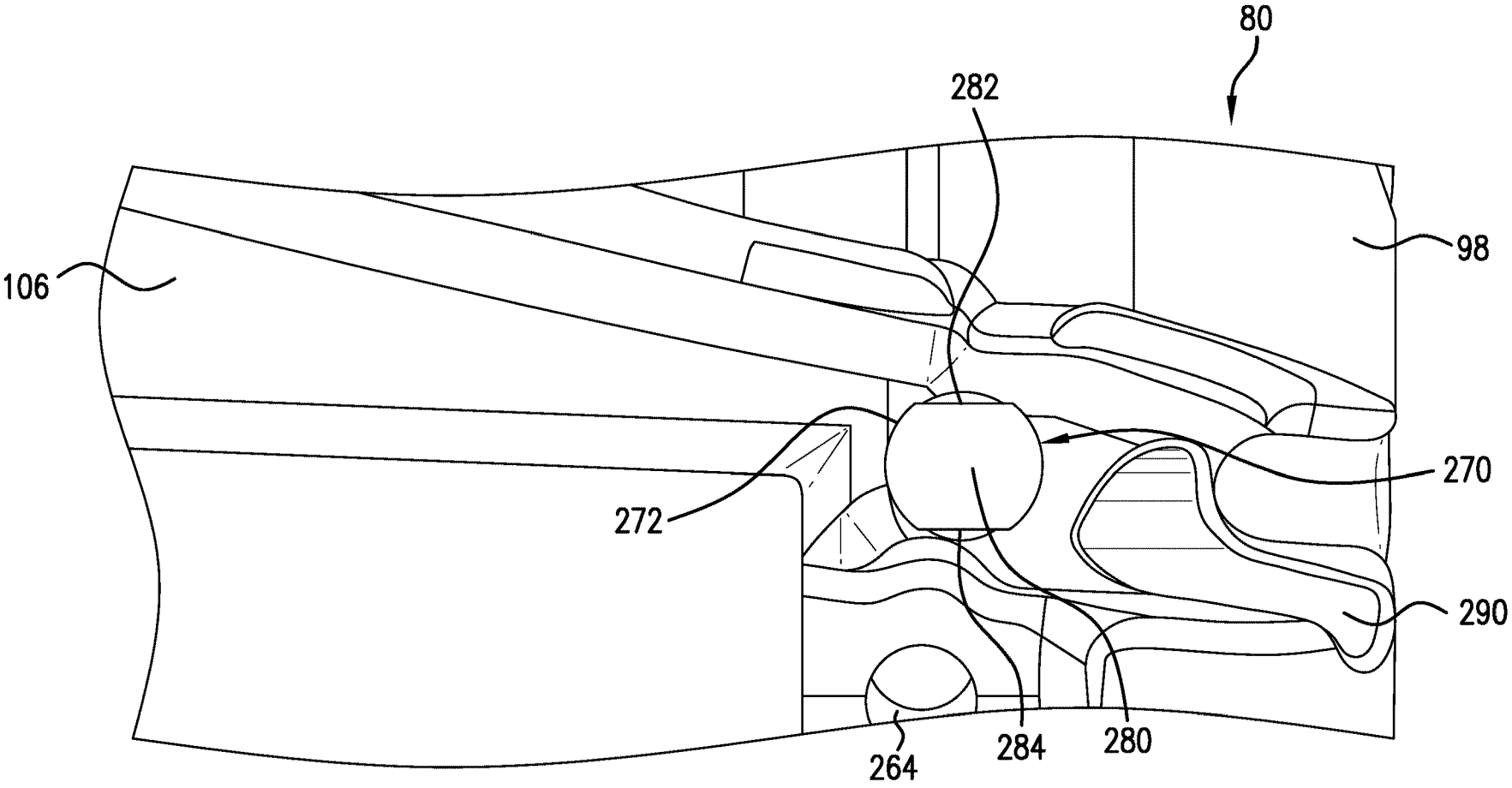
FIG. 19 depicts an external view of a release pin of the connection system of FIG. 18 without a whipstock connector, in accordance with an exemplary aspect.
Figure 20:
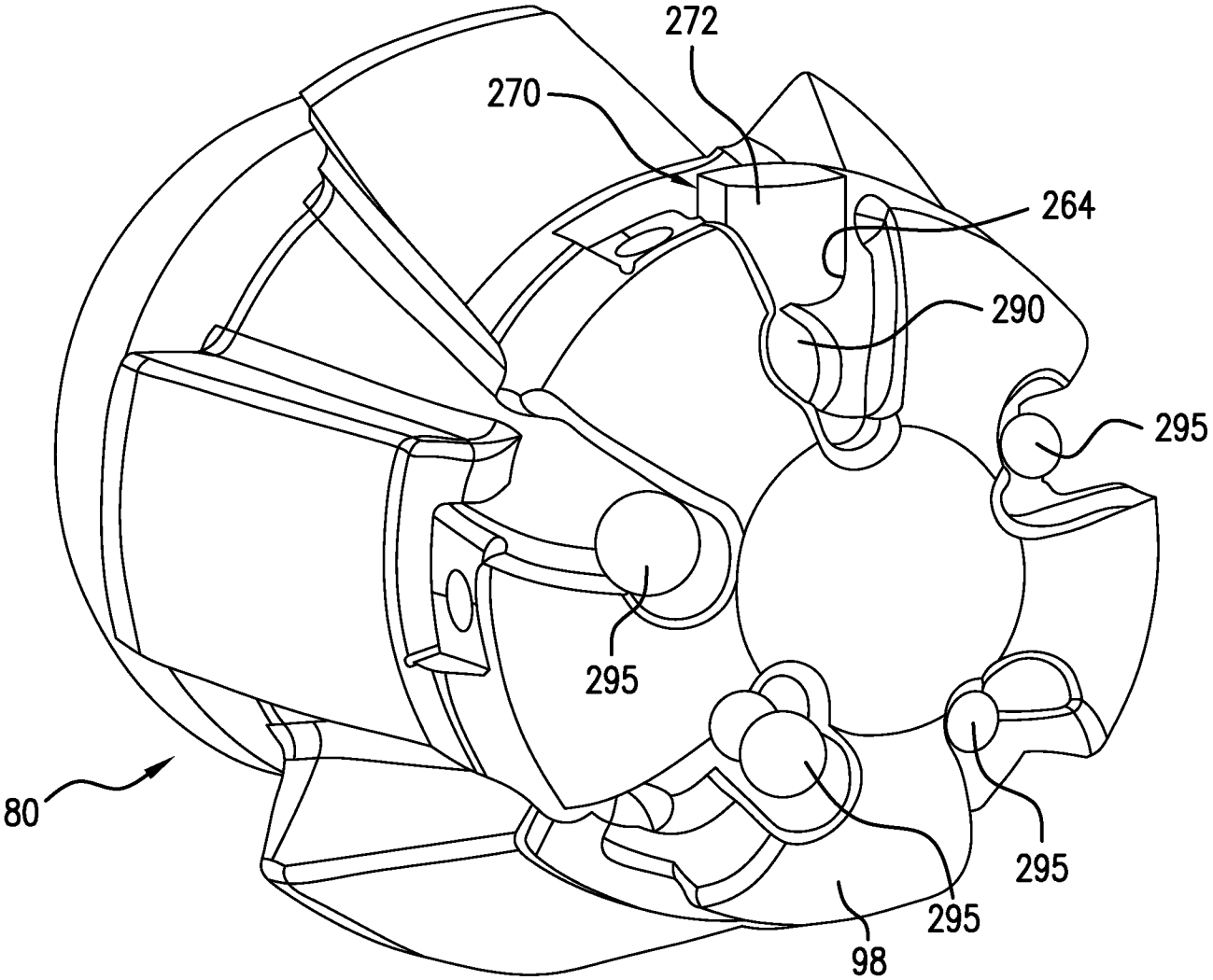
FIG. 20 depicts an end view of a window mill of the connection system of FIG. 18. with the release pin extended to prevent rotation.

In accordance with another exemplary aspect depicted in FIGS. 18-20, wherein like reference numbers represent corresponding parts in the respective views, first end 272 of pin 270 is positioned in front of a circulation port 290. In the unlocked position flow is blocked from going through circulation port 290. When fluid is pumped through axial passage 106 in window mill 80, pressure acts on angled surface 280 forcing pin 270 radially outwardly to the locked position (FIG. 18). When it is desired to release from whipstock connector 82, fluid force pushing pin 270 radially outward is stopped. Window mill 80 may then be rotated to push pins 270 radially inward and then lifted to separate from whipstock connector 82.

In an embodiment, others of circulation ports 290 may be provided with breakoff plugs 295 that block flow until after window mill 80 is detached from whipstock connector 82. After the window mill 80 is disconnected breakoff plugs 295 will be broken when milling is started to allow full fluid flow through all circulation ports 290.

In an embodiment, each pin 270 may include a first flat section 282 and a second flat section 284 at first end 272 (FIG. 19). First and second flat sections 282 and 284 define an anti-rotation feature (not separately labeled) for pin 270. That is, first and second flat sections 282 and 284 may be received by corresponding structure (also not separately labeled) in each radial passage 264 to prevent pin 270 from rotating and allowing angled surface 280 to be out of position. At this point, it should be understood that while pin 270 is shown to include two flat sections, a single flat section may also be employed to prevent undesirable rotation.

Set Forth Below are Some Embodiments of the Foregoing Disclosure:

Embodiment 1. A window cutting system comprising: a whipstock connector including an inner surface having at least one projection; a window mill connected to the whipstock connector, the window mill including a body having a connector member, a tip portion, a recess formed on an outer surface of the body, an axial passage extending from the connector member toward the tip portion and a radial passage extending outwardly from the axial passage; and a pin arranged in the radial passage and selectively extending into the recess.

Embodiment 2. The window cutting system according to any prior embodiment, wherein the radial passage is fluidically connected to the axial passage.

Embodiment 3. The window cutting system according to any prior embodiment, further comprising: a piston arranged in the axial passage, the piston selectively urging the pin radially outwardly into the recess.

Embodiment 4. The window cutting system according to any prior embodiment, further comprising at least one frangible element connecting the piston to the body.

Embodiment 5. The window cutting system according to any prior embodiment, wherein the piston includes a first end, and a second end, the second end including an angled surface portion abutting the pin.

Embodiment 6. The window cutting system according to any prior embodiment, wherein the pin includes a first end having a first angled surface that abuts the angled surface portion of the piston and a second end having a second angled surface.

Embodiment 7. The window cutting system according to any prior embodiment, wherein the radial passage includes a first radial passage supporting a first pin and a second radial passage supporting a second pin.

Embodiment 8. The window cutting system according to any prior embodiment, further comprising: a travel limiter arranged in the axial passage, the travel limiter being selectively arranged between the first pin and the second pin.

Embodiment 9. The window cutting system according to any prior embodiment, wherein the frangible element comprises a frangible stud configured to fail under tensile stress.

Embodiment 10. The window cutting system according to any prior embodiment, further comprising: a piston travel limiter arranged at the axial passage.

Embodiment 11. The window cutting system according to any prior embodiment, therein the piston includes an annular recess selectively receptive of the pin.

Embodiment 12. The window cutting system according to any prior embodiment, further comprising: a spring arranged in the radial passage, the spring applying a radially inwardly directed force to the pin.

Embodiment 13. The window cutting system according to any prior embodiment, further comprising: at least one frangible member preventing inward movement of the pin.

Embodiment 14. The window cutting system according to any prior embodiment, wherein the radial passage includes a plurality of radial passages that extend outwardly from the axial passage.

Embodiment 15. The window cutting system according to any prior embodiment, wherein the pin includes a first end having an angled surface exposed in the axial passage and a second end that engages the whipstock connector.

Embodiment 16. The window cutting system according to any prior embodiment, wherein the first end of the pin includes at least one flat section.

Embodiment 17. The window cutting system according to any prior embodiment, further comprising: a plurality of circulation ports extending through the window mill and a pin moveably mounted in the window mill, wherein the pin selectively restricts flow through the plurality of circulation ports.

Embodiment 18. The window cutting system according to any prior embodiment, further comprising: a frangible plug arranged in one or more of the plurality of circulation ports.

Embodiment 19. The window cutting system according to any prior embodiment, further comprising: an insert arranged in the axial passage, the insert including a central passage and a pin pocket that extends into the insert toward the central passage, the pin being arranged in the pin pocket.

Embodiment 20. The window cutting system according to any prior embodiment, wherein the pin includes a first end extending into the pin pocket and a second end that selectively engages the whipstock connector, the first end including a seal that forms an atmospheric chamber in the pin pocket.

Embodiment 21. The window cutting system according to any prior embodiment, wherein the pin is secured in the pin pocket through a frangible link.

Embodiment 22. A method of detaching a window mill from a whipstock connector comprising: adjusting a fluid force applied to the window mill; and shifting a pin extending between the window mill and the whipstock connector.

Embodiment 23. The method according to any prior embodiment, wherein adjusting the fluid force includes adjusting fluid pressure applied to a piston arranged in an axial passage of the window mill.

Embodiment 24. The method according to any prior embodiment, wherein adjusting the fluid force includes removing a fluidic force applied to the piston.

Embodiment 25. The method according to any prior embodiment, wherein shifting the piston includes forcing the pin into an angled surface of the piston to shear a frangible element.

Embodiment 26. The method according to any prior embodiment, wherein forcing the pin includes rotating the window mill.

Embodiment 27. The method according to any prior embodiment, wherein shifting the piston includes applying a tensile force to a frangible element Embodiment 28. The method according to any prior embodiment, wherein adjusting the fluid force on the piston reduces a force acting on a frangible member between the window mill and the whipstock connector.

Embodiment 29. The method according to any prior embodiment, wherein adjusting the fluid force includes exposing a pin arranged in a pin pocket of the window mill to fluid pressure.

Embodiment 30. The method according to any prior embodiment, wherein exposing the pin to fluid pressure includes shifting the pin radially inwardly into an atmospheric chamber defined in the pin pocket.

Embodiment 31. The method according to any prior embodiment, wherein shifting the pin radially inwardly includes breaking a shear link connecting the pin with the pin pocket.

Embodiment 32. The method according to any prior embodiment, wherein adjusting the fluid force includes guiding the fluid force through an axial passage in the window mill toward an angled section of the pin.

Embodiment 33. The method according to any prior embodiment, wherein guiding the fluid force toward the angled section of the pin includes shifting the pin radially outwardly of the window mill toward the whipstock connector.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A window cutting system comprising:

a whipstock connector including an inner surface having at least one projection;

a window mill connected to the whipstock connector, the window mill including a body having a connector member, a tip portion, a recess formed on an outer surface of the body, an axial passage extending from the connector member toward the tip portion and a radial passage extending outwardly from the axial passage, the radial passage being fluidically connected to the axial passage; and a pin arranged in the radial passage and selectively extending into the recess.

2. The window cutting system according to claim 1, further comprising: a piston arranged in the axial passage, the piston selectively urging the pin radially outwardly into the recess.

3. The window cutting system according to claim 2, further comprising: at least one frangible element connecting the piston to the body.

4. The window cutting system according to claim 3, wherein the piston includes a first end, and a second end, the second end including an angled surface portion abutting the pin.

5. The window cutting system according to claim 4, wherein the pin includes a first end having a first angled surface that abuts the angled surface portion of the piston and a second end having a second angled surface.

6. The window cutting system according to claim 3, wherein the radial passage includes a first radial passage supporting a first pin and a second radial passage supporting a second pin.

7. The window cutting system according to claim 6, further comprising: a travel limiter arranged in the axial passage, the travel limiter being selectively arranged between the first pin and the second pin.

8. The window cutting system according to claim 7, wherein the frangible element comprises a frangible stud configured to fail under tensile stress.

9. The window cutting system according to claim 8, further comprising: a piston travel limiter arranged at the axial passage.

10. The window cutting system according to claim 3, therein the piston includes an annular recess selectively receptive of the pin.

11. The window cutting system according to claim 10, further comprising: a spring arranged in the radial passage, the spring applying a radially inwardly directed force to the pin.

12. The window cutting system according to claim 2, further comprising: at least one frangible member preventing inward movement of the pin.

13. The window cutting system according to claim 1, wherein the radial passage includes a plurality of radial passages that extend outwardly from the axial passage.

14. The window cutting system according to claim 13, wherein the pin includes a first end having an angled surface exposed in the axial passage and a second end that engages the whipstock connector.

15. The window cutting system according to claim 14, wherein the first end of the pin includes at least one flat section.

16. The window cutting system according to claim 1, further comprising: a plurality of circulation ports extending through the window mill and another pin moveably mounted in the window mill, wherein the another pin selectively restricts flow through the plurality of circulation ports.

17. The window cutting system according to claim 16, further comprising: a frangible plug arranged in one or more of the plurality of circulation ports.

18. The window cutting system according to claim 1, further comprising: an insert arranged in the axial passage, the insert including a central passage and a pin pocket that extends into the insert toward the central passage, the pin being arranged in the pin pocket.

19. The window cutting system according to claim 18, wherein the pin includes a first end extending into the pin pocket and a second end that selectively engages the whipstock connector, the first end including a seal that forms an atmospheric chamber in the pin pocket.

20. The window cutting system according to claim 18, wherein the pin is secured in the pin pocket through a frangible link.

21. A method of detaching a window mill from a whipstock connector comprising:

adjusting a fluid force applied to the window mill by adjusting fluid pressure applied to a piston arranged in an axial passage of the window mill; and shifting a pin extending between the window mill and the whipstock connector.

22. The method of claim 21, wherein adjusting the fluid force includes removing a fluidic force applied to the piston.

23. The method of claim 21, wherein shifting the piston includes forcing the pin into an angled surface of the piston to shear a frangible element.

24. The method of claim 21, wherein forcing the pin includes rotating the window mill.

25. The method of claim 21, wherein shifting the piston includes applying a tensile force to a frangible element.

26. The method of claim 21, wherein adjusting the fluid force on the piston reduces a force acting on a frangible member between the window mill and the whipstock connector.

27. The method of claim 21, wherein adjusting the fluid force includes exposing a pin arranged in a pin pocket of the window mill to fluid pressure.

28. The method of claim 27, wherein exposing the pin to fluid pressure includes shifting the pin radially inwardly into an atmospheric chamber defined in the pin pocket.

29. The method of claim 28, wherein shifting the pin radially inwardly includes breaking a shear link connecting the pin with the pin pocket.

30. The method according to claim 28, wherein adjusting the fluid force includes guiding the fluid force through an axial passage in the window mill toward an angled section of the pin.

31. The method according to claim 30, wherein guiding the fluid force toward the angled section of the pin includes shifting the pin radially outwardly of the window mill toward the whipstock connector.

* * * * *